US005296447A

United States Patent [19]

Suto et al.

[11] Patent Number: 5,296,447

[45] Date of Patent: Mar. 22, 1994

[54] IMAGE RECEIVING SHEET

[75] Inventors: Kenichiro Suto; Kazunobu Imoto; Nobuhisa Nishitani, all of Tokyo, Japan

[73] Assignee: Dai Nippon Insatsu Kabushiki Kaisha, Japan

[21] Appl. No.: 99,402

[22] Filed: Jul. 30, 1993

Related U.S. Application Data

[63] Continuation of Ser. No. 474,109, Apr. 30, 1990, abandoned.

[30] Foreign Application Priority Data

Aug. 31, 1988 [JP] Japan ..... 63-217580
Oct. 25, 1988 [JP] Japan ..... 63-267113
Jun. 13, 1989 [JP] Japan ..... 1-148301

[51] Int. Cl.[5] ..... B41M 5/035; B41M 5/38

[52] U.S. Cl. ..... 503/227; 428/195; 428/206; 428/913; 428/914

[58] Field of Search ..... 8/471; 428/195, 206, 428/323, 327, 328, 330, 331, 412, 413, 474.4, 480, 500, 521, 913, 914; 503/227

[56] References Cited

U.S. PATENT DOCUMENTS 4,720,480 1/1988 Ito et al. ..... 503/227

FOREIGN PATENT DOCUMENTS 60-245593 12/1985 Japan ..... 503/227
61-112693 5/1986 Japan ..... 503/227
61-295085 12/1986 Japan ..... 503/227
62-198497 9/1987 Japan ..... 503/227
63-214484 9/1988 Japan ..... 503/227
63-307988 12/1988 Japan ..... 503/227

*Primary Examiner*—B. Hamilton Hess
*Attorney, Agent, or Firm*—Parkhust, Wendel & Rossi

[57] ABSTRACT

The image receiving sheet according to the present invention is an image receiving sheet which receives dye migrated by heat from a heat transfer sheet, wherein the image receiving sheet includes a substrate (3), a dye receiving layer (3) provided on one surface of the substrate and a curl prevention layer. The curl prevention layer includes a non-heat stretchable and shrinkable resin having a heating stretching or shrinking ratio within the range from −1.0 to 1.5% in JIS-K-6734 provided on the surface of the substrate on the side opposite to the above dye receiving layer, or between the substrate and the dye receiving layer. In the present invention, by having such a curl prevention layer as mentioned above, generation of curl by heat during image formation can be prevented to provide an image receiving sheet excellent in both conveyability of sheet and printing quality.

16 Claims, 1 Drawing Sheet

IMAGE RECEIVING SHEET

This is a continuation of application Ser. No. 07/474,109 filed Apr. 30, 1990, now abandoned.

TECHNICAL FIELD

This invention relates to an image receiving sheet for heat transfer recording, more particularly to an image receiving sheet for heat transfer recording which is excellent in curl preventability and slippability (conveyability) in a printer, without printing trouble, and capable of forming an image of high image quality.

BACKGROUND ART

In the prior art, various heat transfer methods have been known. Among them, there has been proposed a method in which a sublimable dye is used as the recording material, which is carried on a substrate sheet such as a paper or a plastic sheet to provide a heat transfer sheet. Various full-color images are formed on an image receiving sheet dyeable with a sublimable dye, for example, an image receiving sheet having a dye receiving layer provided on the surface of a paper or a plastic film.

For this method, a thermal head of a printer is used as the heating means, and a large number of color dots of 3 colors or 4 colors are transferred onto an image receiving sheet by heating for a very short time, thereby reproducing the full-color image of the original by color dots of multiple colors.

The image thus formed is very sharp and also excellent in transparency, because the colorants used are dyes, and therefore the image obtained is excellent in reproducibility and gradation of the intermediate color, and is similar to an image obtained by conventional offset printing or gravure printing. It has also become possible to form an image of high quality comparable with full-color photographic image.

The heat transfer image receiving sheet to be used in the sublimation type heat transfer system, when a reflected image is required as in the printed matters or photography, one having a dye receiving layer comprising a resin having good dyeability provided on the surface of an opaque substrate sheet such as paper or synthetic paper is used, while when a light-transmissive image is required as used in OHP (overhead projector), one having a dye receiving layer provided on a transparent substrate sheet such as polyester film is used.

In any case, when image formation is effected by use of these image receiving sheets, as the result of heating of the surface of the image receiving sheet during transfer, warping (curl) tends to occur on the image receiving sheet, whereby slippability of the image receiving sheet after printing becomes worse and causes the problem of paper jamming. Also, since it is necessarily unavoidable to heat the whole printer to a certain temperature, curl is generated within the printer also before printing, whereby conveyability of the image receiving sheet is worsened to generate a problem such as double delivery, etc.

Further, in the case of forming a multi-color image, since printing is performed for 3 to 4 times on the same image receiving sheet, curl becomes excessive and generates non-matching of the printed dots and lower image quality. Particularly in the case of a light-transmissive image for OHP, a lowering in the image quality becomes further marked, because the printing image is projected with enlargement to several fold.

The present invention has been accomplished in view of the above-mentioned problem. The object of the present invention is to provide an image receiving sheet, which does not curl due to the heat applied thereto by a thermal head during image transfer, can make delivery of the sheet better during image transfer, and will not give rise to color slippage or deformation of the image transferred on the receiving layer.

DISCLOSURE OF THE INVENTION

The image receiving sheet according to the present invention is an image receiving sheet for receiving the dye migrated from a heat transfer sheet by heat, characterized in that the image receiving sheet comprises a substrate, a dye receiving layer provided on one surface of said substrate, and a curl prevention layer provided on the surface of the substrate opposite to the dye receiving layer, said curl prevention layer comprising a non-heat shrinkable and stretchable resin having a heating shrinkage or stretchability in JIS-K-6734 within the range of from −1.0 to 1.5%.

BRIEF DESCRIPTION OF THE DRAWINGS

The drawings show an example of the present invention.

BEST MODE FOR PRACTICING THE INVENTION

Figure 1:
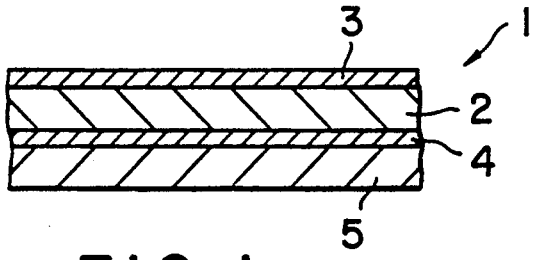
FIG. 1 shows a longitudinal sectional view of an image receiving sheet of the present invention provided with a curl prevention layer on the backside of the substrate.

FIG. 1 shows an example of the image receiving sheet 1, and the sheet 1 is constituted by providing a dye receiving layer 3 on one surface of a substrate 2, and further providing a curl prevention layer 5 comprising a resin with small heating shrinkage through a primer layer 4 on the surface of the substrate 2 on the opposite side to the side where the dye receiving layer 3 is provided.

As the above substrate 2, films, sheets of plastics, synthetic papers, cellulose fiber papers, etc. may be used. As the plastic film or sheet, for example, there can be used films, sheets comprising polyethylene terephthalate, polyolefin, polyvinyl chloride, polyvinylidene chloride, polystyrene, polycarbonate, polyphenylene sulfane, polyether sulfone, polyether ether ketone, polyether imide, polyarylate, acrylic resins such as polymethyl methacrylate, etc., and also these white films, sheets added with fillers and formed into white films, sheets, or foamed films obtained by effecting fine foaming can be used, but in the case for use in OHP, those having high transparency and further those with high heat resistance are preferable and polyethylene terephthalate film is generally employed. As the synthetic paper, there may be included those comprising a polyolefin resin or another synthetic resin as the resin component mixed by addition of an inorganic filler, etc. thereto and extrusion molded into shapes of films, sheets, or those prepared by coating an extender pigment on resin films, sheets such as polystyrene, polyester, polyolefin, etc. As the cellulose fiber paper, pure paper, coated paper, cast coated paper, paper impregnated etc. may be included. The thickness of the substrate 2 may be preferably 30 to 200 μm, particularly 50 to 150 μm.

As the material constituting the dye receiving layer 3, one which can receive a dye migrated from the heat transfer sheet, for example, an image of a sublimable disperse dye, and maintain the image formed by reception is used, but any of those which have been used in the prior art for the receiving layer of this kind of image receiving sheet may be available. Examples of such material may include either one or mixtures of two or more kinds of the following synthetic resins (a) to (e).

(a) Those having ester bond:

polyester, polyacrylate, polycarbonate, polyvinyl acetate, styrene-acrylate resin, vinyl toluene-acrylate resin, etc.

(b) Those having urethane bond: polyurethane, etc.

(c) Those having amide bond: polyamide (nylon, etc.).

(d) Those having urea bond: urea resin, etc.

(e) Those having other bonds with high polarity:

polycaprolactone, polystyrene, polyvinyl chloride, polyacrylonitrile, etc.

Also, the dye receiving layer 3 can be constituted of a mixed resin of a saturated polyester and a vinyl chloride-vinyl acetate copolymer. In this case, the vinyl chloride-vinyl acetate copolymer should be preferably one having a content of vinyl chloride component of 85 to 97% by weight and a polymerization degree of about 200 to 800. It is not limited to the case consisting of a copolymer only of vinyl chloride and vinyl acetate, but also those containing vinyl alcohol component, maleic acid component may be employed.

Further, the dye receiving layer 3 can be also constituted of a styrene type resin other than polystyrene as mentioned above. As such styrene type resin, there may be included homopolymers or copolymers of styrene type monomers such as styrene, α-methylstyrene, vinyl toluene and the like, or copolymers of these monomers with other monomers, for example acrylic or methacrylic monomers such as acrylates, methacrylates, acrylonitrile, methacrylonitrile and the like, and maleic anhydride, etc.

In the present invention, in the above dye receiving layer 3, a UV-absorber can be also added, if necessary. By addition of a UV-ray absorber, weathering resistance of the dye dyed on the receiving layer by migration from the heat transfer sheet can be improved. As the UV-ray absorber, benzophenone type, hindered amine type, benzotriazole type may be included. Its amount added may be about 0.05 to 5 parts by weight based on 100 parts by weight of the resin constituting the receiving layer 3.

In the above dye receiving layer 3, it is also possible to incorporate a release agent for the purpose of improving the peel-off characteristic from the heat transfer sheet, if necessary. As the release agent, solid waxes such as polyethylene wax, amide wax, Teflon powder, etc., surfactants such as fluorine type or phosphoric acid ester type or silicone oils may be employed, but silicone oils are preferred. As silicone oils, oily ones may be employed, but cured type oils are preferred. As the cured type silicone oil, the reaction cured type, the photocured type, the catalyst cured type, etc. may be included, but silicone oils of the reaction cured type are particularly preferred. As the reaction cured type silicone oil, those cured by the reaction between amino-modified silicone oils and epoxy-modified silicones are preferred. The amount of these cured type silicone oils added may be preferably 0.5 to 30 parts by weight based on 100 parts of the resin constituting the dye receiving layer 3. Addition of the release agent is not limited to incorporating into the dye receiving layer 3, but a release agent layer may be also formed by coating and drying a solution or a dispersion of a release agent in an appropriate solvent on the surface of the dye receiving layer 3. As the release agent constituting the release agent layer, the reaction cured product of amino-modified silicone oil and epoxy-modified silicone oil as mentioned above is particularly preferred. The release agent layer should be preferably formed to a thickness of 0.01 to 5 μm, particularly 0.05 to 2 μm. The release agent layer may be provided either on a part of the surface of the dye receiving layer 3 or the whole surface, but when the release agent layer is provided on a part of the surface of the dye receiving layer 3, recording by dot impact recording, heat-sensitive melt transfer recording or pencil, etc. can be performed on the portion where no release agent layer is provided, and sublimation transfer recording is performed on the portion where the release agent is provided, while recording according to another recording system is performed on the portion where no release agent is provided. Thus, the sublimation transfer recording system and another recording system can be used in combination.

When the substrate 2 comprises a resin such as vinyl chloride, polyester, vinyl chloride-vinyl acetate copolymer, vinyl chloride-acrylic polymer, etc., since the surface of these resins has dye receptivity and releasability, no dye receiving layer 3 may be separately provided.

The curl prevention layer 5, comprising a non-heat stretchable and shrinkable resin having small heating shrinkage and being provided through the primer layer 4 on the surface of the substrate 2 on the opposite side to the side where the dye receiving layer 3 is provided, comprises a heat-resistant or semi-heat-resistant resin having a heat shrinkage of −1.0 to 1.5% and a softening temperature of 90° C. or higher in JIS-K-6734 (100° C., 10 minutes). Examples of such resins may include polyacryl, polyurethane, polycarbonate, vinylidene chloride, epoxy, polyamide, polyester, etc. The thickness of the curl prevention layer 5 should be preferably 1 to 10 μm, particularly 3 to 10 μm. The curl prevention layer 5 can be formed by the method in which a melted resin or a resin dissolved in a solvent is coated, the method in which these resins are formed into films, sheets, and adhered, etc. The primer layer 4 is provided for the purpose of improving adhesiveness between the substrate 2 and the curl prevention layer 5, and as the resin constituting the primer layer 4, polyurethane, polyacryl, polyester, epoxy, etc. may be included. The primer layer 4 is not necessarily required to be provided depending on the materials of the substrate 2 and the curl prevention layer 5, when adhesiveness between both is good.

Figure 2:
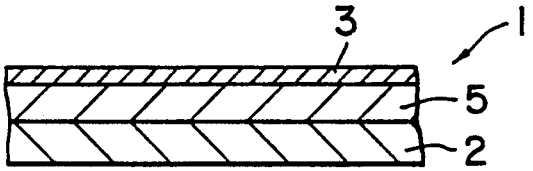
FIG. 2 shows a longitudinal sectional view of an image receiving sheet provided with a curl prevention layer between the substrate and the dye receiving layer.

The image receiving sheet 1 of the present invention can also provide the curl prevention layer 5 between the substrate 2 and the dye receiving layer 3 as shown in FIG. 2, and also, although not particularly shown, can provide it both between the substrate 2 and the dye receiving layer 3 and on the backside of the substrate 2.

Figure 3:
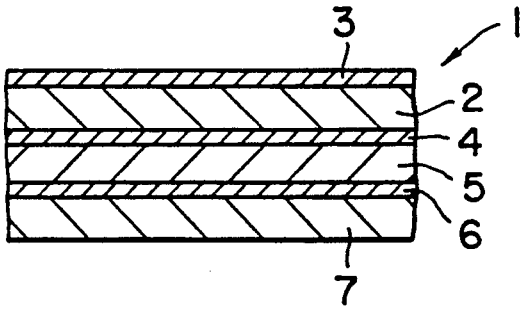
FIG. 3 and FIG. 4 show longitudinal sectional views showing other embodiments of the present invention, respectively.
Figure 4:
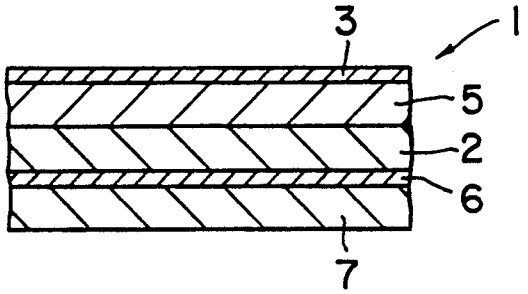

The image receiving sheet 1 can also have a support sheet 7 for improving paper passage characteristic of the image receiving sheet 1 within the transfer device adhered on the backside of the curl prevention layer 5 or the substrate 2 freely peelably through a tackifier layer 6 as shown in FIG. 3, FIG. 4. As the support sheet 7, either transparent or opaque sheet may be used, and as its material, for example, synthetic paper, cellulose fiber paper, synthetic resin sheet, etc. may be employed. As the synthetic paper, there may be employed those of the type of a polyolefin resin filled with a filler, which is extruded and stretched, those of the type of a sheet of a polyolefin, polystyrene, polyester, coated with a mixture comprising a filler and a binder, etc. As the cellulose fiber paper, pure paper, coated paper, art paper, cast coated paper, converted paper, impregnated.-coated or internally added with a synthetic resin or a rubber, converted paper extrusion laminated with polyethylene, etc. can be used. As the synthetic resin sheet, there may be employed transparent films of polyethylene terephthalate, polypropylene, rigid vinyl chloride, etc. alone, sheets obtained by extrusion of these materials added with fillers such as clay, calcium carbonate, titanium oxide, etc. or laminated papers of the above resin or the resin containing the filler extruded on a pure paper, etc., or these papers having formed fine unevenness on the surface by the sand blast method, the emboss method, etc.

By providing further a lubricating layer on the back of the support sheet 7, paper passage characteristic can be further improved. The lubricating layer can be formed by coating a methacrylate resin such as methyl methacrylate or a corresponding acrylate resin, a vinyl type resin such as vinyl chloride-vinyl acetate copolymer, etc.

The tackifier layer 6 can be constituted of a conventional tackifier such as polyacrylic acid ester, an acrylic copolymer, natural rubber, a synthetic rubber, petroleum resin, a block copolymer such as SIS, SBR, etc., but a weakly tacky tackifier is preferable for making peel-off of the support sheet 7 easier. As the weak tackifier, one having property of weak tackiness to the curl prevention layer 5 or the substrate 2 may be selected and employed, or a conventional tackifier as mentioned above in which inorganic particles are kneaded or a release agent is mixed to impart releasability thereto may be employed.

On the back of the image receiving sheet 1 of the present invention, a detection mark for registration in a transfer device during transfer can be also printed (the surface on which the detection mark is provided may include the case of the back of the substrate 2, the back of the curl prevention layer, or the case of the support sheet 7, etc.

Direct formation of Curl Prevention Layer

Whereas, as described above, in the heat transfer method by use of sublimable dyes, since the colorants used are dyes, image formation with excellent transparency is possible, whereby formation of an image having resolution, gradation and color reproducibility, etc. approximate to silver salt photography is possible. For example, the uses are not limited for viewing of reflected light images, but the method has characteristics which are very useful in the field utilizing images by transmitted light, such as formation of OHP images.

As the transferable material, namely image receiving sheet to be used for formation of OHP images as mentioned above, polyethylene terephthalate sheet or film excellent in transparency has been employed, but since said film has high crystallinity and insufficient dyeability, a dye receiving layer has been required to be formed on the film surface from a resin having excellent dye dyeability.

The present inventor has made investigations about dyeability of various transparent films, and found that polyvinyl chloride (hereinafter called PVC) resin films, particularly PVC sheets containing a certain extent of plasticizers have good dye dyeability, and formation of the dye receiving layer can be omitted. However, soft PVC sheets involve the problem that curl is liable to be formed by the heater of the printer during heat transfer or the light source of OHP, whereby there is the problem that correct formation of transferred images and projected images can be effected only with difficulty.

Such problem can be solved by forming a transparent resin layer (for example, an acrylic resin layer) subjected little to stretching and shrinkage by heat on the back of a PVC sheet (namely on the opposite surface of the image forming surface), but since adhesiveness between the PVC sheet and the acrylic resin is inferior, cumbersomeness is involved that a primer layer or an adhesive layer is required to be formed on the surface of the PVC sheet, whereby there is the problem that transparency must be sacrificed to some extent by formation of the primer layer or the adhesive layer.

In the present invention in forming a non-heat stretchable and shrinkable resin layer (curl prevention layer) on one surface of a PVC sheet, by forming a non-heat stretchable and shrinkable resin solution dissolved in a solvent which swells or dissolves the above PVC sheet, an image receiving sheet excellent in transparency and curl prevention characteristic can be economically provided without forming a primer layer or an adhesive layer.

The PVC sheet per se to be used in the embodiment of the present invention as mentioned above has been well known in the art, but in the present invention, a semi-rigid or soft PVC sheet containing a plasticizer may be preferably used. As the plasticizer, there may be employed all of those known in the art such as dibutyl phthalate, di-n-octyl phthalate, di-(2-ethylhexyl) phthalate, dinonyl phthalate, dilauryl phthalate, butyl lauryl phthalate, butyl benzyl phthalate, di-(2-ethylhexyl) adipate, di-(2-ethylhexyl) sebacate, tricresyl phosphate, tri-(2-ethylhexyl) phosphate, polyethylene glycol ester, epoxy fatty acid ester, etc. The amount of these plasticizers employed may be 5 to 80 parts by weight, particularly preferably within the range of from 10 to 50 parts by weight, per 100 parts by weight of the above PVC. If the amount of the plasticizer used is too small, dyeability for a sublimable dye is insufficient, while if it is too much, rigidity of the sheet is deficient to make the sheet too soft, and also blurring occurs in the printed image during sublimation transfer so that a sharp image undesirably cannot be obtained. Such plasticizer not only imparts softness and dye dyeability to the sheet, but also exhibits the effect of preventing adhesion between the PVC sheet and the heat transfer sheet during heat transfer.

Also, in the preferred embodiment of the present invention, it has been also found that there is no blocking with the heat transfer sheet during transfer, and also the dyeability with a sublimable dye is further improved, even when a plasticizer may be included in PVC in a relatively larger amount, for example, at a ratio of 30 to 80 parts by weight, by including further 0.1 to 10 parts by weight of a lubricant per 100 parts by weight of PVC in addition to the above plasticizer.

As such lubricant, all of the lubricants known in the art such as fatty acids, fatty acid amides, waxes, paraffins, etc. can be used. If the amount of these lubricants added is too small, there is no effect by addition, while if it is too much, surface roughening with the PVC resin sheet obtained will undesirably occur. Also, by use of these lubricants, not only dyeability of a sublimable dye is improved, but also adhesion between the sublimation heat transfer sheet and the PVC resin sheet is little even by use of a relatively higher temperature during sublimation transfer, whereby an image of high density can be formed further efficiently. The main components of the PVC sheet to be used in the present invention are as described, but of course in the present invention, further UV-ray absorbers, antistatic agents, heat stabilizers, antioxidants, fluorescent brighteners, fillers, etc. can be also used as desired.

The PVC resin sheet to be used in the present invention is obtained by blending the necessary components as described above, and molding the blended product by the known formation method such as the calendering method, the extrusion method, etc. into a sheet with a thickness of, for example, about 10 to 300 μm.

The curl prevention layer to be formed on one surface of the PVC sheet as described above is formed from a resin which is relatively hard, low in stretchability and shrinkability by heating and also excellent in transparency. Suitable as such resin which is hard, low in stretchability and shrinkability and excellent in transparency may be acrylic resins, polystyrene type resins, polycarbonate type resins, polyester type resins, etc., and particularly useful resins are acrylic resins. As acrylic resins, there have been widely known thermoplastic, thermosetting, catalyst curable, UV-ray curable, electron beam curable resins, etc., all of which can be used in the present invention. All of these resins are available on the market and can be used in the present invention.

The curl prevention layer is formed by preparing a coating material or an ink having a suitable resin as described above in an organic solvent and coating and drying the solution on one surface of the PVC sheet.

In the embodiment as described above, the organic solvent as used above is particularly important, and it is necessary to select an organic solvent which swells or dissolves the above-mentioned PVC sheet. More specifically, when a coating material or an ink is coated, by swelling or dissolution of at least a part of the surface of the PVC sheet with the organic solvent in the coating material or the ink, the curl prevention layer formed is integrated with the PVC sheet, whereby adhesiveness between both becomes markedly higher and formation of the primer layer or the adhesive layer as in the prior art can be omitted, and for the reason which is not clear, transparency of the PVC sheet itself has been markedly improved.

As described above, as the organic solvent which swells or dissolved the PVC sheet, aromatic solvents such as benzene, toluene, xylene, chlorobenzene, etc. or halogenated hydrocarbons such as chloroform, methylene chloride, trichloroethylene, perchloroethylene, etc. are useful, and these solvents can be also used by controlling swellability or solubility for the PVC sheet by mixing with other solvents in general for coating material or ink such as methyl ethyl ketone, methyl isobutyl ketone, ethyl acetate, butyl acetate, isopropyl alcohol, butanol, petroleum spirit, etc.

The above-mentioned solvent dissolves the resin as described above, gives printing or coating material adaptability by control of the concentration and the viscosity, and is coated and cured by drying on the surface of the above PVC sheet according to conventional means such as the gravure printing method, the bar coating method, the screen printing method, the gravure off-set printing method, the gravure coating method, etc. to form a curl prevention layer. The thickness of these curl prevention layers may be about 1 to 20 μm.

Slippable Curl Prevention Layer

The present inventor, as described above, has previously obtained an excellent effect by forming a curl prevention layer in a heat transfer image receiving sheet as the method of solving the problem of curl.

However, the above-mentioned image receiving sheet provided with the curl prevention layer, when set in a plurality of sheets piled up in a paper feeding unit of a printer, there ensues the problem of double delivery due to great frictional coefficient of the upper curl prevention layer of the image receiving sheet and the dye receiving layer of the image receiving sheet therebeneath. Such problem can be solved by plastering a tacky sheet having excellent slip characteristic every time, but such method has the problem that it is very cumbersome.

In the present invention, by forming the curl prevention layer of the image receiving sheet with a resin having little heating stretching degree and shrinkage containing a specific filler, an image receiving sheet excellent in curl prevention characteristic and slip characteristic, without printing trouble and capable of forming an image of high image quality is provided.

The image-receiving sheet in the above-mentioned embodiment of the present invention comprises a substrate sheet, a dye receiving layer formed on the surface of the substrate sheet and a slippable curl prevention layer formed on the back of the substrate sheet.

The slippable curl prevention layer in this embodiment has the objects to prevent curl of the image receiving sheet by the heat of the thermal head during heat transfer, and to lower the frictional coefficient with the dye receiving layer when superposed, thereby improving slippability, and is formed from a resin with low heating stretchability and shrinkability and a filler.

Preferable examples of the resin with low heating stretchability and shrinkability may include acrylic resins, polyurethane resins, polycarbonate resins, vinylidene chloride resins, epoxy resins, polyamide resins, polyester resins, etc., and among them, although resins having various thermal characteristics may exist, particularly preferable resins are those having a heating shrinkage within the range of from −1.0 to 1.5%, and a softening temperature of 90° C. or higher in JIS-K-6734 (100° C., 10 min.).

As the filler to be used, there may be included plastic pigments such as fluorine resin, polyamide resin, styrene resin, styrene.acrylic crosslinked resin, phenol resin, urea resin, melamine, resin, aryl resin, polyimide resin, benzoguanamine resin, etc., and inorganic fillers such as calcium carbonate, silica, clay, talc, titanium oxide, magnesium hydroxide, zinc oxide, etc. Among them, particularly particles having high heat resistance are preferred, and the particle size may be suitably about 0.5 to 30 μm.

These fillers can be used either alone or in a mixture, and selection of the filler employed may be selected and determined depending on the use purpose of the image receiving sheet to be obtained. For example, in the case of an image receiving sheet for reflection image, since the curl prevention layer may become opaque, inorganic fillers with low transparency such as titanium oxide, zinc oxide, etc. may be employed. However, for light transmissive image, it is preferable to use a plastic segment with high transparency or an inorganic filler with small particle size. As to the amount used, which also depends on the filler to be used, may be generally 0.02 to 10% by weight of the filler in the slippable curl prevention layer, and a preferable range may be from 0.05 to 2% by weight. If the amount of the filler is less than the above range, the improvement effect of slippability is insufficient, while if it exceeds the above range, scattering of transmitted light becomes excessive in transparent uses such as OHP, etc., and also light transmittance is undesirably lowered.

The method for forming the slippable curl prevention layer is a method in which a solution of the resin as described above added with the above-mentioned filler, and further added with necessary additives is dissolved in an appropriate solvent, or a dispersion thereof in an organic solvent or water is formed by coating and drying according to formation means such as gravure printing, screen printing method, reverse roll coating method by use of gravure plate, and the thickness of the curl prevention layer formed is generally about 1 to 10 μm. In forming the curl prevention layer, when adhesiveness between the curl prevention layer and the substrate sheet is not good, it is preferable to form a primer layer from a polyurethane resin, a polyester resin, an acrylic resin, an epoxy resin, etc.

Further, the image receiving sheet of the present invention can provide a cushioning layer between the substrate sheet and the dye receiving layer, if necessary, and by provision of such a cushioning layer, the noise during printing is reduce and images corresponding to image informations can be transfer recorded with good reproducibility.

Further, a detection mark can be also provided. Detection marks are extremely convenient in effecting registration between the heat transfer sheet and the image receiving sheet, etc., and for example, a detection mark detectable by a photoelectric tube detecting device can be provided by printing, etc. on the back of the substrate sheet, etc. Of course, these detection marks may be freely peelable.

The heat transfer sheet to be used in performing heat transfer by use of the image receiving sheet of the present invention as described above has a dye layer containing a sublimable dye provided on a paper or a polyester film, and all of heat transfer sheets known in the prior art are available as such in the present invention.

For the means for imparting heat energy during heat transfer, all of known imparting means known in the prior art can be used. For example, by means of a recording device such as a thermal printer (for example, Video Printer VY-100, Hitachi Seisakusho K.K.), etc. by controlling the recording time to impart heat energy of about 5 to 10 mJ/mm$^2$, the desired object can be sufficiently accomplished.

The present invention is described in more detail by referring to Examples and Comparative Examples. In the sentences, parts or % are based on weight unless particularly otherwise noted.

EXAMPLE A1, COMPARATIVE EXAMPLE A1

By use of a transparent PET with a thickness of 75 μm (Toray K.K., Japan: T-75) as the substrate, an ink composition for formation of dye receiving layer shown below was coated by a bar coater to a coated amount on drying of 5 g/m$^2$ and dried by a dryer, followed by drying in an oven at 80° C. for 10 minutes, to form a dye receiving layer.

| Ink composition for formation of receiving layer | |
|---|---|
| Polyester (Vylone 600: Toyo Boseki K.K., Japan) | 4.0 parts |
| Vinyl chloride-vinyl acetate copolymer (#1000 A: Denki Kagaku Kogyo K.K., Japan) | 6.0 parts |
| Amino-modified silicone (X-22-3050C: Shin-etsu Kagaku Kogyo K.K., Japan) | 0.2 part |
| Epoxy-modified silicone (X-22-3000E: Shin-etsu Kagaku Kogyo K.K., Japan) | 0.2 part |
| Solvent (MEK: Toluene = 1:1) | 89.6 parts |

Next, on the surface on the opposite side to the side where the dye receiving layer was provided, a primer having the following composition was coated by a bar coater to a coated amount on drying of 1 g/m$^2$ and dried by a dryer, then an ink composition for formation of a curl prevention layer with a composition shown below was coated to 3 g/m$^2$ on drying and dried by a dryer, followed further by drying in an oven at 80° C. for 10 minutes, to obtain an image-receiving sheet.

| Primer composition | |
|---|---|
| Polyester polyol (Adcoat AD335AE: Toyo Morton K.K., Japan) | 15 parts |
| Solvent (MEK: dioxane = 2:1) | 85 parts |
| **Ink composition for formation of curl prevention layer** | |
| Acrylic resin (BR-85: Mitsubishi Rayon K.K., Japan) | 10 parts |
| Solvent (MEK) | 90 parts |

On the other hand, with a polyester film with a thickness of 4.5 μm provided on one surface with a heat-resistant lubricating layer comprising a thermosetting acrylic resin (Toray K.K.: Lumilar 5AF53) as the substrate, a heat transfer layer was formed on the surface on the opposite side to the side where the heat-resistant lubricating layer was provided by coating an ink composition for heat transfer formation with the composition shown below to a coated amount after drying of 1 g/m$^2$ to obtain a heat transfer sheet.

| Yellow ink composition for formation of heat transfer layer | |
|---|---|
| Disperse dye (Macrolex Yellow 6G: Bayer) (Disperse Yellow 201) | 5.5 parts |
| Polyvinyl butyral (Ethlec BX-1, Sekisui Kagaku K.K.) | 4.5 parts |
| Methyl ethyl ketone | 45 parts |
| Toluene | 45 parts |

By use of the above heat transfer sheet and the image receiving sheet, transfer was effected under the following conditions and the extent of curl was examined. Similarly, by use of a transparent PET with a thickness of 100 μm (T-100: Toray), a transparent PET with a thickness of 125 μm (T-125: Toray) as the substrate, the same image receiving layer and curl prevention layer as described above were formed thereon, and by use of these image receiving sheets, and also by use of the image receiving sheets having only receiving layers similarly provided as described above on the three kinds of transparent PET as described above, transfer was effected and the extents of curl were examined. The results are listed together in Table A1.

Transfer Conditions

Transfer printer: VY-50 (Hitachi Seisakusho K.K., Japan)

Printing energy: 90 mJ/mm$^2$

One color high density solid printing

TABLE A1

| Substrate | | Curl *1 (cm) |
|---|---|---|
| Example | | |
| T-75 | 75 μm | 1.0 |
| T-100 | 100 μm | 1.2 |
| T-125 | 125 μm | 1.2 |
| Comparative Example | | |
| T-75 | 75 μm | 7.3 |
| T-100 | 100 μm | 6.2 |
| T-125 | 125 μm | 6.1 |

*1: Method of testing extent of curl

The sheet after transfer was placed on a flat place, the distances from the flat surface to the four corners of the sheet were measured, and the average value was

EXAMPLE A2, COMPARATIVE EXAMPLE A2

On the backside of each curl prevention layer of the same image receiving sheets as in Example A1 (three kinds substrates with thicknesses of 75 μm, 100 μm, 125 μm), white PET (E-20, Toray K.K.) with a thickness of 38 μm was further laminated with a tackifier (SDyne AE349: Sekisui Kagaku, thickness 3 μm), and by use of the image receiving sheets obtained, and the three kinds of the image receiving sheets having white PET laminated similarly as described above on the back surface of the same three kinds of the substrates of image receiving sheets as in Comparative Example A1 (Comparative Example A2), transfer was effected under the same conditions as in Example A1 and the extents of curl were examined. The results are shown in Table A2.

TABLE A2

| Substrate | | Curl *1 (cm) |
|---|---|---|
| Example | | |
| T-75 | 75 μm | 0.9 |
| T-100 | 100 μm | 1.2 |
| T-125 | 125 μm | 1.0 |
| Comparative Example | | |
| T-75 | 75 μm | 6.9 |
| T-100 | 100 μm | 6.0 |
| T-125 | 125 μm | 5.7 |

EXAMPLE A3, COMPARATIVE EXAMPLE A3

On the back surface of two kinds of vinyl chloride sheets with a thickness of 150 μm (C-3033 and C-0436: Mitsubishi Jushi K.K., Japan) and two kinds of vinyl sheets with a thickness of 200 μm (C-3033 and C-4020: Mitsubishi Jushi K.K., Japan) were coated by a bar coater an ink composition for formation of curl prevention layer the .composition shown below to 3 g/m$^2$ on drying and dried by a dryer, followed by drying in an oven at 50° C. for 5 minutes, to obtain image receiving sheets (since the substrate itself had dye receptivity, no receiving layer was provided). On each of the four kinds of image receiving sheets obtained, and the four kinds of the image sheets formed into image receiving sheets as such without provision of the curl prevention layer on the back surface of each of the above substrates as Comparative Examples, transfer was effected under the same conditions as the respective Examples A1, and the extents of curl were examined. The results are shown in Table A3.

| Ink composition for formation of curl prevention layer | |
|---|---|
| Acrylic resin (BR-85: Mitsubishi Rayon K.K.) | 10 parts |
| Solvent (Toluene: ethyl acetate = 1:1) | 90 parts |

TABLE A3

| Substrate | | Curl *1 (cm) |
|---|---|---|
| Example | | |
| C-3033 | 150 μm | 0 |
| C-3033 | 200 μm | 0 |
| C-0436 | 150 μm | 0.2 |
| C-4020 | 200 μm | 0.3 |
| Comparative Example | | |
| C-3033 | 150 μm | 4.2 |
| C-3033 | 200 μm | 4.5 |
| C-0436 | 150 μm | 5.6 |
| C-4020 | 200 μm | 5.3 |

EXAMPLE A4, COMPARATIVE EXAMPLE A4

On the curl prevention layer side of each of the same image receiving sheets as in Example A3, Comparative Example A3 was further laminated a white PET with a thickness of 38 μm (E-20: Toray) to provide an image receiving sheet. By use of these respective image receiving sheets, transfer was effected under the same conditions as in Example A1, and the extent of curl was examined. The results are shown in Table A4.

TABLE A4

| Substrate | | Curl *1 (cm) |
|---|---|---|
| Example | | |
| C-3033 | 150 μm | 0 |
| C-3033 | 200 μm | 0 |
| C-0436 | 150 μm | 0.1 |
| C-4020 | 200 μm | 0 |
| Comparative Example | | |
| C-3033 | 150 μm | 3.2 |
| C-3033 | 200 μm | 3.6 |
| C-0436 | 150 μm | 5.3 |
| C-4020 | 200 μm | 4.9 |

EXAMPLE A5, COMPARATIVE EXAMPLE A5

On one surface of the same substrate as in Example A1, an ink composition for formation of a curl prevention layer with small heating shrinkage having the composition shown below was coated by a bar coater to 5 g/m$^2$ on drying and dried by a dryer, and then the same ink composition for formation of receiving layer as in Example A1 was coated on the resin layer surface to 5 g/m$^2$ on drying and dried, followed further by drying in an oven at 80° C. for 10 minutes to form a receiving layer to provide an image receiving sheet. By use of these respective image receiving sheets, transfer was effected under the same conditions and the extent of curl was examined. The results are shown in Table A5. Also, in Table A5, the results of Comparative Example A1 are also shown together for comparison.

| Ink composition for formation of curl prevention layer |
|---|

-continued

| | |
|---|---|
| Polyurethane (Takelac E-360: Takedayakuhin Kagaku K.K.) | 15 parts |
| Solvent (MEK: Toluene: = 1:1) | 85 parts |

TABLE A5

| Substrate | | Curl *1 (cm) |
|---|---|---|
| Example | | |
| T-75 | 75 μm | 5.3 |
| T-100 | 100 μm | 4.5 |
| T-125 | 125 μm | 3.8 |
| Comparative Example | | |
| T-75 | 75 μm | 7.3 |
| T-100 | 100 μm | 6.2 |
| T-125 | 125 μm | 6.1 |

EXAMPLE B1

On one surface of a soft PVC sheet (C-3033, thickness 150 μm, Mitsubishi Jushi K.K.) was coated a 10% toluene solution of an acrylic resin (BR-85, Mitsubishi Rayon K.K.) by a bar coater at a ratio of 3 g/m$^2$ based on solids, dried on air, followed by drying in a heating furnace of 50° C. for 5 minutes to form a curl prevention layer, thus obtaining an image receiving sheet of the present invention.

EXAMPLE B2

An image receiving sheet of the present invention was obtained in the same manner as in Example B1 except for using a soft PVC sheet (C-0436, thickness 150 μm, Mitsubishi Jushi K.K.) in place of the PVC sheet in Example B1, BR-100 (Mitsubishi Rayon K.K.) as the acrylic resin, and xylene as the solvent.

EXAMPLE B3

In place of the soft PVC sheet in Example B1, a soft PVC sheet (C-0633, thickness 200 μm, Mitsubishi Jushi K.K.) was used, and as the acrylic resin, a UV-ray softenable resin coating material 2% benzophenone (Allonix 5700, Toa Gosei K.K.) was coated by a bar coater at a ratio of 3 g/m$^2$, and cured by a high pressure mercury lamp to form a curl prevention layer, thus obtaining an image receiving sheet of the present invention.

EXAMPLE B4

On the same PVC sheet as in Example B1 was coated as an acrylic resin an electron beam curable resin coating material (dipentaerythritol hexaacrylate) by a bar coater at a ratio of 3 g/m$^2$, and cured by an electron beam irradiating device to form a curl prevention layer, thus obtaining an image receiving sheet of the present invention.

COMPARATIVE EXAMPLE B1

An image receiving sheet of Comparative Example was obtained in the same manner as in Example B1 except for using methyl ethyl ketone in place of toluene in Example B1.

COMPARATIVE EXAMPLE B2

An image receiving sheet of Comparative Example was obtained in the same manner as in Example B2 except for using isopropyl alcohol in place of xylene in Example B2.

Printing was performed on the image receiving sheets of the present invention and Comparative Examples, and comparison was made as to generation of curl immediately after printing, adhesion strength of curl prevention layer and whole transparency, to give the results shown below in Table B1.

TABLE B1

| | Curl | Adhesion strength | Trnaparency | Dot slippage |
|---|---|---|---|---|
| Example B1 | ○ | ○ | ○ | ○ |
| Example B2 | ○ | ○ | ○ | ○ |
| Example B3 | ○ | ○ | ○ | ○ |
| Example B4 | ○ | ○ | ○ | ○ |
| Comparative Example B1 | X | X | X | X |
| Comparative Example B2 | X | X | X | X |

Curl: judged from manner of warping when placed on a flat plane
○: warping of 1 mm or less for A4 size
X: warping of 100 mm or more for A4 size
Adhesion strength: peel-off strength with Cellotape
○: no peel-off
X: 50% or more peeled off
Transparency: judged by light transmittance
○: 90% or more
X: 80% or less
Slippage of dot: judged by the following method
○: 1 mm or less
X: 5 mm or more An ink composition for formation of a dye carrying layer having the following composition was prepared, coated by a wire bar and dried on a polyethylene terephthalate film with a thickness of 6 μm applied with a heat-resistant treatment on the back to a dry coating amount of 1.0 g/m$^2$ to obtain heat transfer sheets of yellow and black colors.

| | |
|---|---|
| Yellow dye (black dye) | 1.0 part |
| Polyvinyl butyral resin | 10.0 parts |
| Methyl ethyl ketone/toluene (weight ratio 1/1) | 90.0 parts |

The above yellow heat transfer sheet and each of the image receiving sheets of Examples and Comparative Examples as described above were superposed with the respective dye layer and dye receiving layer being opposed to each other, and yellow printing was performed with a thermal head from the back of the heat transfer sheet under the conditions of a head application voltage of 12.0 V, a pulse width of 16 m.sec., a dot density of 6 dots/line, subsequently printing was performed on the same position, and the slippage between the yellow dot and the black dot was examined by enlarged projection by OHP to 50-fold, to give the results shown in the above Table B1.

EXAMPLE C1

By use of a transparent polyethylene terephthalate film (T-75, thickness 75 μm, Toray K.K.) as the substrate sheet, a coating solution having the following composition was coated on one surface by a bar coater at a ratio to 5.0 g/m$^2$ on drying, dried by a dryer, and then further dried in an oven of 80° C. for 10 minutes to form a dye receiving layer.

| Composition for dye receiving layer: | |
|---|---|
| Polyester (Vylone 600: Toyobo K.K.) | 4.0 parts |
| Vinyl chloride/vinyl acetate copolymer (#1000 A: Denki Kagaku Kogyo K.K.) | 6.0 parts |
| Amino-modified silicone (X-22-3050C, Shin-etsu Kagaku Kogyo K.K.) | 0.2 part |
| Epoxy-modified silicone (X-22-3000E, Shin-etsu Kagaku Kogyo K.K.) | 0.2 part |

-continued

| Composition for dye receiving layer: | |
|---|---|
| Methyl ethyl ketone/toluene (weight ratio 1/1) | 89.6 parts |

On the back of the above film was coated a coating solution for primer layer having the following composition at a ratio to 1.0 g/m$^2$ on drying, dried by a dryer, and further a coating solution for curl prevention layer having the following composition was coated at a ratio to 3.0 g/m$^2$ on drying, simply dried by a dryer, followed further by drying in an oven of 80° C. for 10 minutes to form a curl prevention layer, thus obtaining an image receiving sheet of the present invention.

| Composition for primer layer: | |
|---|---|
| Polyester polyol (Adcoat, Toyo Morton K.K.) | 15.0 parts |
| Methyl ethyl ketone/dioxane (weight ratio 2/1) | 85.0 parts |
| Composition for curl prevention layer: | |
| Acrylic resin (BR-85, Mitsubishi Rayon K.K.) | 10.0 parts |
| Filler (Orgasol 2002D, Nippon Lilsan K.K.) | 0.1 part |
| Methyl ethyl ketone/toluene (weight ratio 1/1) | 89.9 parts |

EXAMPLE C2

An image receiving sheet of the present invention was obtained in the same manner as in Example Cl except for using a transparent polyethylene terephthalate film (T-100, thickness 100 μm, Toray K.K.) in place of the substrate sheet in Example C1.

EXAMPLE C3

An image receiving sheet of the present invention was obtained in the same manner as in Example C1 except for using a transparent polyethylene terephthalate film T-125, thickness 125 μm, Toray K.K.) in place of the substrate sheet in Example C1.

EXAMPLES C4 TO C9

Image receiving sheets of the present invention were obtained in the same manner as in Example C1 except for using a transparent polyethylene terephthalate film (T-100, thickness 100 μm, Toray K.K.) in place of the substrate sheet in Example C1, and using the following fillers.

EXAMPLE C4

Orgasol 2002 D (nylon resin)=0.1 part

EXAMPLE C5

Orgasol 2002 UL-D (nylon resin)=0.1 part

EXAMPLE C6

Siloid 244 (Fuji Davidson K.K. (microsilica))=0.1 part

EXAMPLE C7

Lublon L-5 (Daikin Kogyo K.K. (Teflon resin))=0.1 part

EXAMPLE C8

Magster #5 (Tateho Kagaku K.K. (magnesium hydroxide))=0.1 part

EXAMPLE C9

Orgasol 2002 D (nylon resin)=0.1 part+Lublon L-5 (Teflon resin))=0.02 part

COMPARATIVE EXAMPLES C1 TO C3

In the curl prevention layer coating solutions in Examples C1 to C3, no filler was used, and 90.0 parts of the solvent were used, following otherwise the same procedure as in Examples C1 to C3, to obtain image receiving sheets of Comparative Examples C1 to C3.

USE EXAMPLE

A yellow sublimation type heat transfer sheet (Dainippon Insatsu K.K.) and each of the image receiving sheets of the present invention and Comparative Examples as described above were superposed with the respective dye layer and dye receiving layer being opposed to each other, and printing was performed with a thermal head from the back of the heat transfer sheet with a printing energy of 90 mJ/mm$^2$ by means of a heat-sensitive sublimation transfer printer (VY-50, Hitachi Seisakusho K.K.) to obtain a printed matter.

EVALUATION METHODS

(1) Printing Curl Degree

The printed matter obtained was cut into A4 size, this was placed on a flat place, and the curl of the printed matter was evaluated by measuring the distance from the flat surface. The measuring places were 4 corners of the printed matter, and the value was shown by an average value.

(2) Paper Feeding and Discharging Characteristics

In carrying out printing in the above use example, continuous printing was performed by setting the image sheets piled up in 50 sheets in a printer paper feeding unit. However, for giving sensor adaptability, the tip end and the both sides of the image receiving sheet were coated with white ink, and further a mark was provided with black ink. The above evaluation was repeated for 5 times, and when the image receiving sheets were delivered as overlapped in two or more sheets or when paper jamming of the printed image receiving sheet occurred during paper discharging, evaluation was made as N.G., while evaluation was made as O.K. when there is no problem.

The results shown below in Table C1 were obtained.

As is apparent from Table C1 shown below, by addition of a filler in the curl prevention layer, excellent slip characteristic can be obtained together with having curl prevention effect, whereby the problem of conveyability during paper feeding and paper discharging has been solved.

TABLE C1

| | Printing curl (cm) | Paper feeding and discharging characteristic |
|---|---|---|
| Example C1 | 1.0 | O.K. |
| Comparative Example C1 | 1.1 | N.G. |
| Example C2 | 1.2 | O.K. |
| Comparative Example C2 | 1.2 | N.G. |
| Example C3 | 1.2 | O.K. |
| Comparative Example C3 | 1.2 | N.G. |
| Example C4 | 1.1 | O.K. |
| Example C5 | 1.3 | O.K. |
| Example C6 | 1.0 | O.K. |
| Example C7 | 1.1 | O.K. |
| Example C8 | 1.2 | O.K. |
| Example C9 | 1.1 | O.K. |

FIELD OF UTILIZATION IN INDUSTRY

The image receiving sheet of the present invention can be used widely for image formation according to the heat-sensitive transfer system by use of dot-shaped heating printing means such as a thermal head.

We claim:

1. An image receiving sheet for receiving dye migrated by heat from a heat transfer sheet, comprising a substrate, a dye receiving layer provided on one surface of said substrate, and a curl prevention layer provided on the surface of the substrate opposite to the dye receiving layer, said curl prevention layer comprising (i) a resin that is non-heat shrinkable and stretchable, and has a heating shrinkage or stretchability measured by JIS-K-6734 within a range of from −1.0 to 1.5%, and (ii) a filler which makes the curl prevention layer slippery, said filler having a particle size of from 0.5 to 30 μm and being present in said curl prevention layer in an amount of 0.02 to 10% by weight.

2. An image receiving sheet according to claim 1, wherein the non-heat stretchable and shrinkable resin is an acrylic resin.

3. An image receiving sheet according to claim 1, wherein the non-heat stretchable and shrinkable resin comprises at least one material selected from the group consisting of polyurethane resins, polycarbonate resins, vinylidene chloride resins, epoxy resins, polyamide resins, and polyester resins.

4. An image receiving sheet according to claim 1, wherein the filler comprises an organic filler, and the organic filler comprises at least one plastic pigment selected from the group consisting of fluorine resins, polyamide resins, styrene resins, styrene-acrylic cross-linked resins, phenol resins, urea resins, melamine resins, aryl resins, polyimide resins, and benzoquanamine resins.

5. An image receiving sheet according to claim 1, wherein the filler comprises an inorganic filler, and the inorganic filler comprises at least one material selected from the group consisting of calcium carbonate, silica, clay, talc, titanium oxide, magnesium hydroxide, and zinc oxide.

6. An image receiving sheet according to claim 1, wherein the dye image receiving sheet is substantially transparent.

7. An image receiving sheet according to claim 6, wherein said filler comprises at least one material selected from the group consisting of plastic pigments with high transparency and inorganic fine particles with particle sizes of 1 μm or less.

8. An image receiving sheet for receiving dye migrated by heat from a heat transfer sheet, comprising a polyvinyl chloride sheet, and a curl prevention layer provided on one surface of said polyvinyl chloride sheet, said curl prevention layer comprising (i) a resin that is non-heat shrinkable and stretchable, and has a heating shrinkage or stretchability measured by JIS-K-6734 within a range of from −1.0 to 1.5%, and (ii) a filler which makes the curl prevention layer slippery, said filler having a particle size of from 0.5 to 30 μm and being present in said curl prevention layer in an amount of 0.02 to 10% by weight.

9. An image receiving sheet according to claim 8, wherein the curl prevention layer is formed by the steps of coating the surface of the substrate comprising the polyvinyl chloride sheet with a composition comprising a non-heat shrinkable and stretchable resin and a solvent which swells or dissolves polyvinyl chloride, said solvent comprising an aromatic solvent or a halogenated hydrocarbon solvent; and drying the thus coated composition.

10. An image receiving sheet according to claim 8, wherein the non-heat stretchable and shrinkable resin is an acrylic resin.

11. An image receiving sheet according to claim 8, wherein the non-heat stretchable and shrinkable resin comprises at least one material selected from the group consisting of polyurethane resins, polycarbonate resins, vinylidene chloride resins, epoxy resins, polyamide resins, and polyester resins.

12. An image receiving sheet according to claim 8, wherein the filler comprises an organic filler, and the organic filler comprises at least one plastic pigment selected from the group consisting of fluorine resins, polyamide resins, styrene resins, styrene-acrylic cross-linked resins, phenol resins, urea resins, melamine resins, aryl resins, polyimide resins, and benzoquanamine resins.

13. An image receiving sheet according to claim 8, wherein the filler comprises an inorganic filler, and the inorganic filler comprises at least one material selected from the group consisting of calcium carbonate, silica, clay, talc, titanium oxide, magnesium hydroxide, and zinc oxide.

14. An image receiving sheet according to claim 8, wherein the dye image receiving sheet is substantially transparent.

15. An image receiving sheet according to claim 14, wherein said filler comprises at least one material selected from the group consisting of plastic pigments with high transparency and inorganic fine particles with particle sizes of 1 μm or less.

16. A method of preventing curling of an image receiving sheet for receiving dye migrated by heat from a heat transfer sheet, said method comprising:

providing a substrate;

forming a dye receiving layer on one surface of said substrate; and forming a curl prevention layer on a surface of said substrate, said curl prevention layer comprising (i) a resin that is non-heat shrinkable and stretchable, and has a heating shrinkage or stretchability measured by JIS-K-6734 within a range of from −1.0 to 1.5%, and (ii) a filler which makes the curl prevention layer slippery, said filler having a particle size of from 0.5 to 30 μm and being present in said curl prevention layer in an amount of 0.02 to 10% by weight;

whereby said curl prevention layer prevents said image receiving sheet from exhibiting any substantial curling.

* * * * *